US005765614A

United States Patent [19]

Kardosh

[11] Patent Number: 5,765,614

[45] Date of Patent: Jun. 16, 1998

[54] HOPPER INSERT FOR REFUSE BAGS

[75] Inventor: Wallace J. Kardosh, 31016 Gloede, Warren, Mich. 48093

[73] Assignees: Wallace J. Kardosh, Warren; Thomas J. Schomberger, Commerce Township, Oakland County; Mitchell L. Dictor, West Bloomfield; William Kopanakis, Livonia; Dino R. Muzzin, Washington Township, Macomb County, all of Mich.

[21] Appl. No.: 805,651

[22] Filed: Feb. 27, 1997

[51] Int. Cl.[6] ..... B65B 1/04

[52] U.S. Cl. ..... 141/390; 141/316

[58] Field of Search ..... 141/390, 391, 141/316, 10, 12, 73, 80, 114; 248/97, 99; 53/390; 100/295, 245–247; 15/257.1

[56] References Cited

U.S. PATENT DOCUMENTS

| | | | |
|---|---|---|---|
| D. 256,770 | 9/1980 | Broyles | 100/295 |
| 2,688,429 | 9/1954 | Davison | 141/365 |
| 2,827,931 | 3/1958 | Melvin . | |
| 3,818,956 | 6/1974 | Chamberlain . | |
| 4,037,778 | 7/1977 | Boyle | 248/99 |
| 4,133,356 | 1/1979 | Dillingham . | |
| 4,158,995 | 6/1979 | Kaplan et al. | 100/295 |
| 4,248,278 | 2/1981 | Blodgett . | |
| 4,485,855 | 12/1984 | Dillingham . | |
| 4,890,652 | 1/1990 | Hoerner . | |
| 5,090,309 | 2/1992 | Lai | 100/295 |
| 5,129,609 | 7/1992 | Tobin . | |
| 5,271,589 | 12/1993 | Belous . | |
| 5,292,093 | 3/1994 | Shumake | 248/97 |

OTHER PUBLICATIONS

Package Information of "Grass Hopper" (™) Product of Seiler Plastics, Fenton, MO. Date Unknown (on market since at least May 1997).

Product Package Information Sheet of Refuse Bag Product of Aco Hardware, Farmington Hills, MI; Product Date Aug. 30, 1996, but believed product on market before Feb. 27, 1995.

*Primary Examiner*—J. Casimer Jacyna
*Assistant Examiner*—Steven O. Douglas
*Attorney, Agent, or Firm*—Peter D. Keefe

[57] ABSTRACT

A hopper insert for refuse bags which internally supports the sidewalls of a refuse bag so that it is able to maintain an open shape, while also providing protection of the sidewall of the refuse bag from expansion damage due to efforts by a user to compress the refuse contained therein. The hopper insert is composed generally of a preferably rectilinearly shaped hopper having an open top, an open bottom, and is dimensioned for loosely being inserted inside a refuse bag. A funnel is provided at the top of the hopper which flairs outwardly and upwardly therefrom. When the hopper is inserted into a refuse bag, the funnel is located above the mouth of the refuse bag and provides a sturdy and conveniently larger opening for accepting refuse into the hopper, and thereby, into the refuse bag. Preferably, the corners of the hopper are gently rounded so as to protect the refuse bag from tearing. It is further preferred for the corners at the bottom end portion of the hopper to be vertically slitted and terminate in a bilateral radius, wherein the roundness thereby provided minimizes chances for refuse bag tearing and wherein the slitting provides independent flexibility of the sidewalls as may be needed with respect to frictional or suction/vacuum effects with respect to the refuse bag to thereby more easily vertically pull the hopper out from inside the refuse bag after filling thereof has been completed.

11 Claims, 2 Drawing Sheets

HOPPER INSERT FOR REFUSE BAGS

BACKGROUND OF THE INVENTION

1. Field of the Invention

The present invention relates to refuse bags, particularly of the paper kind used for organic yard waste, such as leaves and grass. More particularly, the present invention relates to a removable hopper insert for refuse bags to provide shape and protection to the sidewalls of the refuse bag during filling thereof.

2. Description of the Prior Art

As landfills become ever more filled, municipalities are increasingly requiring that organic yard waste, such as grass and leaves not be placed curbside for pick-up unless placed in a paper refuse bag. These ref use bags have an ecological advantage over plastic bags, in that the paper of the refuse bag will harmlessly decompose along with the yard waste, a process not likely to happen with plastic bags. Refuse bags are constructed of heavy paper and, for example, may be typically on the order of about 30 gallons in size, but may be otherwise, such as for example a 40 gallon size.

Refuse bags are sold in a folded state, whereby the user unfolds the refuse bag for use. The paper construction of refuse bags enables them to be "self-standing" and "self-opening", which appellations are something of a misnomer, in that the sidewalls of the refuse bag are subject to wind and other conditions which can cause them to collapse or to some degree cave-in on itself along the fold-lines thereof.

By way of exemplification, a refuse bag sold presently on the market is constructed of 2-ply paper, is of a 30 gallon size (16 inches wide (at the front and rear sidewalls), 12 inches deep (at the left and right sidewalls) and 35 inches high), which is capable of holding about 50 pounds of refuse. There are two vertical fold-lines along the left and right sidewalls which terminate near the bottom wall (which is integral with the sidewals) in an inverted V-shape fold-line. The sidewalls have a plurality of horizontal fold-lines.

In operation, a user unfolds the horizontal fold-lines of the refuse bag, then proceeds to open the refuse bag by unfolding the vertical and V-shaped fold lines. The refuse bag is then placed on the ground, whereby its bottom wall provides a stable base to the sidewalls to remain upright under ideal conditions, whereupon the mouth of the refuse bag is ready to accept refuse. However, as pointed out, the open refuse bag while considered by its manufacturers to be "self-standing" and "self-opening" is subject to many vagaries acting on the relatively flaccid sidewalls. Consequently, wind, dampness, unlevel terrain, or to other factors, such as the act of filling the refuse bag, can cause the refuse bag to at least in part collapse.

Since refuse bags are constructed of paper, they are subject to strength weakening under damp conditions, as well as tearing and ripping during filling. Further, unless a user compresses loose organic matter, such as leaves, in the refuse bag, the refuse bag volume will become filled to capacity (ie., 30 gallons) long before its weight capacity (ie., 50 pounds) is reached. Therefore, users may desire to use their hands to pressingly compress loose organic matter in the refuse bag, risking the bag bursting under the compressive forces untowardly transferred to the sidewalls.

Consequently, what is needed in the art is some way to provide temporary strength and shape to the sidewalls of a refuse bag during the filling thereof.

In the prior art, it is known that collapsible trash bags generally can be shape assisted via an insert placed thereinside. For example, U.S. Pat. Nos. 4,890,652 and 5,129,609 teach a bag support in the form of an insert which is itself unfolded and then insertably placed into the bag through its mouth, whereby the bag is caused to assume a open and standing configuration. However, these inserts offer little protection to the bag sidewall if the user should elect to compress refuse placed into the bag, in that the inserts do not have a closed loop perimeter: one vertical corner is unattached, whereat the bag would be subjected to potentially bursting expansive forces during compression of the refuse. Since refuse bags are likely more sensitive to bursting during compression as the paper sidewall thereof is less able to deform than is a plastic trash bag, these devices do not well suit the need at hand regarding refuse bags.

Accordingly, what remains needed in the art is an insert for refuse bags which provides for holding a refuse bag configured in its "self-supporting" and "self-opening" shape, while also providing protection of the sidewall of the refuse bag from damage due to efforts to compress the refuse contained therein.

SUMMARY OF THE INVENTION

The present invention is a hopper insert for refuse bags which internally supports the sidewalls of a refuse bag so that it is able to maintain an open shape, while also providing protection of the sidewall of the refuse bag from expansion damage due to efforts by a user to compress the refuse contained therein.

The hopper insert according to the present invention is composed generally of a preferably rectilinearly shaped hopper having an open bottom, an open top, and is dimensioned for loosely being inserted inside a refuse bag. A funnel is preferably provided at the top of the hopper, wherein the funnel flairs outwardly and upwardly therefrom. When the hopper is inserted into a refuse bag, the funnel is located above the mouth of the refuse bag and provides a sturdy and conveniently larger opening for accepting refuse into the hopper, and thereby, into the refuse bag.

Preferably, the corners of the hopper are gently rounded so as to protect the refuse bag from tearing. It is further preferred for the corners at the bottom end portion of the hopper to be vertically slitted and rounded by bilateral radiusing of the slot, wherein the roundness minimizes chance for refuse bag tearing and wherein the slitting provides independent flexibility of the sidewalls near the bottom as may be needed with respect to frictional or vacuum/suction effects with respect to the refuse bag to thereby more easily vertically pull the hopper out from inside the refuse bag after filling has been completed. It is still further preferred to provide handles on the funnel to aid a user in inserting and removing the hopper with respect to the refuse bag, as well as moving the hopper and refuse bag collectively during filling.

In operation, a user opens a refuse bag in the normal manner so that it is in its "self-standing", "self-opening" configuration. Next, the user places the hopper insert into the mouth of the refuse bag, bottom first, either for example vertically thereinto or from a selected tipped angle. The user then completes the insertion of the hopper insert, wherein the bottom of the hopper rests on the bottom wall of the refuse bag. The user now places refuse into the funnel, whereupon it falls into the hopper and rests on the bottom wall of the refuse bag. If the user wishes, the refuse may be compressed, wherein the expansive forces will be assumed by the hopper and not transmitted to the sidewalls of the refuse container. Preferably in this regard, a plunger tool may be used to compress the refuse downwardly toward the bottom. When filling is completed, the user grasps the funnel and then pulls upwardly away from the refuse bag. The refuse lays on the bottom wall of the refuse bag, so the refuse bag should remain in place on the ground. Flexing of the sidewalls at the corners near bottom via the slits allows the hopper to break-free of the refuse and the sidewall of the refuse bag and lessens generation of suction. After the hopper insert is removed, the refuse bag is sealed and disposed of conventionally, and the hopper insert is ready for its next usage.

Accordingly, it is an object of the present invention to provide a hopper insert for a refuse bag which provides sidewall burst and tear protection, while providing sidewall shape support.

It is an additional object of the present invention to provide a hopper insert for a refuse bag which provides sidewall burst and tear protection, while providing sidewall shape support, wherein provision is made for sidewall flexing near the bottom thereof as an aid to removal after refuse filling is completed.

It is another object of the present invention to provide a hopper insert for a refuse bag which provides sidewall burst and tear protection, while providing sidewall shape support, wherein provision is made for a plunger to compress refuse placed in the hopper.

These, and additional objects, advantages, features and benefits of the present invention will become apparent from the following specifications.

DETAILED DESCRIPTION OF THE PREFERRED EMBODIMENT

Figure 1:
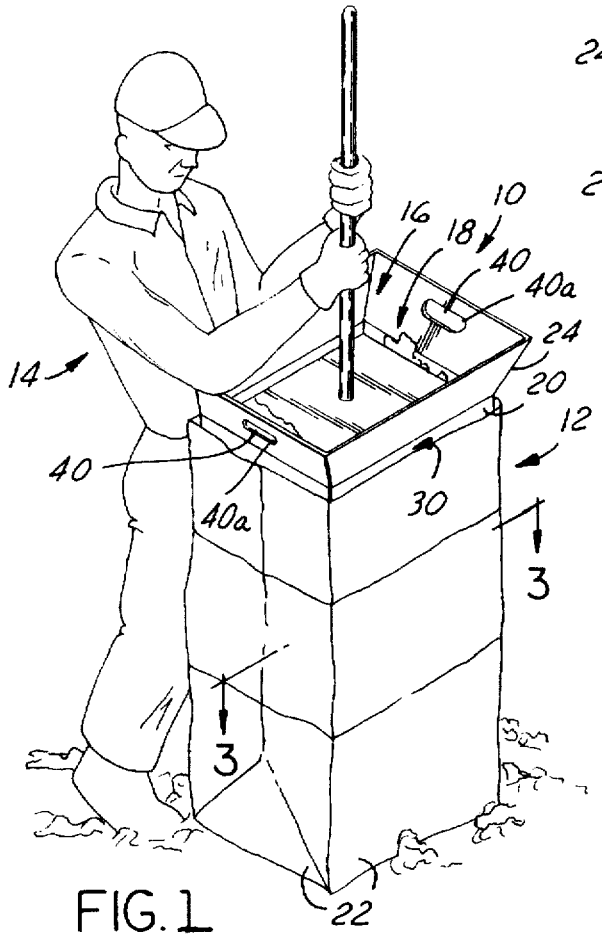
FIG. 1 is a perspective view of the hopper insert according to the present invention, shown in operation with respect to a refuse bag.

Referring now to the drawing, FIG. 1 shows the hopper insert 10 according to the present invention in an environment of operation, wherein the hopper insert is located inside a refuse bag 12 and a user 14 is in the process of filling the refuse bag with the help of the hopper insert. It will be noted the the user is using a compactor tool 16 to tap or push downwardly on the refuse 18 to thereby cause compression of the refuse. The hopper insert 10 includes a hopper 20 which loosely lines the interior of the sidewall 22 of the refuse bag 12 (see FIG. 5). The hopper insert 10 includes, preferably, a funnel 24 which is integrally connected with the hopper 20 which aids the user 14 to place refuse 18, such as for example yard waste, including leaves and grass clippings and other materials of an organic nature.

Figure 3:
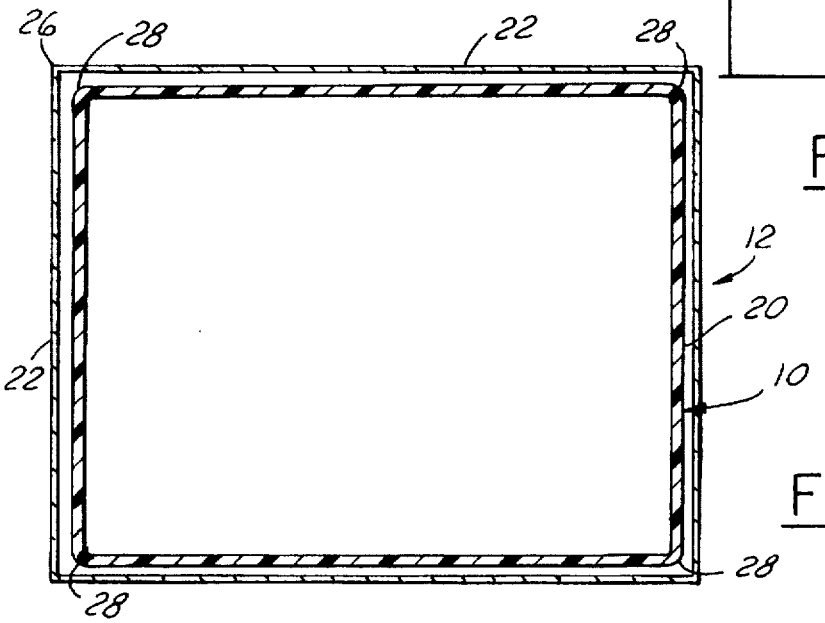
FIG. 3 is a sectional view of the hopper insert and refuse bag, taken along line 3—3 in FIG. 1.
Figure 5:
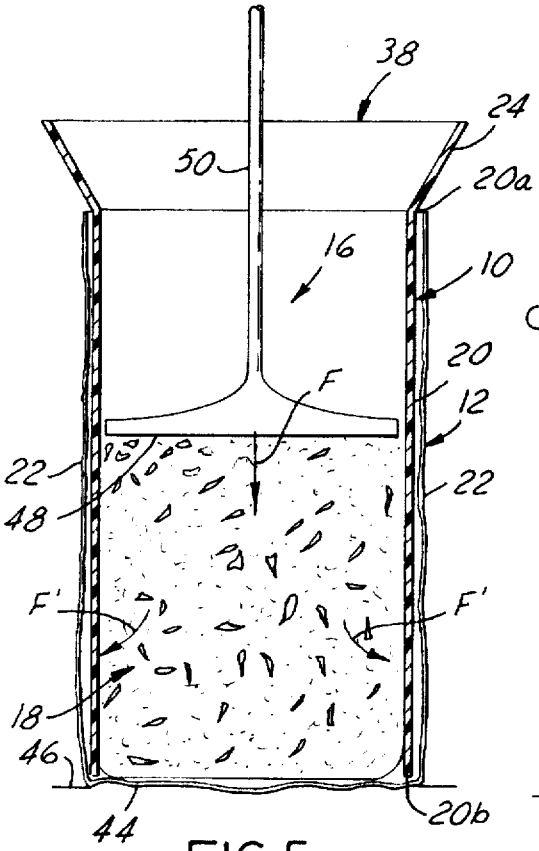
FIG. 5 is a partly sectional side view of the hopper insert according to the present invention shown in operation with respect to a refuse bag, refuse, and a plunger for compressing the refuse.

As indicated by reference to FIGS. 3 and 5, the hopper 20 is generally of a shape which conforms to the shape of the sidewalls 22 of the refuse bag 12. In the depicted example, the sidewalls 22 of the refuse bag 12 have a rectilinear cross-section, whereupon the hopper 20 likewise has a complementary rectilinear cross-section. In this regard, the cross-sectional area of the hopper is preferred to be sufficiently smaller than the cross-sectional area of the sidewalls 22 so that the hopper loosely fits inside the sidewalls. For example, for a refuse bag 12 having a cross-section of 12 inches by 16 inches for its sidewalls 22, the preferred complementary cross-section of the hopper 20 would be, respectively, about 11 inches by 14.5 inches. The looseness of fit of the hopper 20 with respect to the sidewalls 22 of the refuse bag 12 ensures an easy insertion into, and removal from, the refuse bag. Notably, any over zealous compaction of the refuse 18 in the hopper 20 will not result in tearing of the sidewalls 22 no matter how close the interfit between the hopper and the sidewalls of the refuse bag, as the hopper provides protection thereto from compaction forces.

While the cross-section of the sidewalls 22 of the refuse bag 12 may include square corners 26, its is preferred for the cross-section of the hopper 20 to include gently rounded corners 28 (see FIG. 3). The rounded corners 28 ensure that no sharp corner edge will be present which could accidentally tear open the refuse bag 12. Further, insertion of the hopper 20 into the refuse bag 12 is made easier, in that the rounded corners allow for some corner play between the hopper and the sidewall 22 without worry of tearing the sidewall especially at the tear vulnerable mouth 30 thereof.

As indicated by FIGS. 1 and 5, the height of the hopper 20 is higher than the height of the sidewalls 22 of the refuse bag 12. Where a funnel 24 is included with the hopper insert 10, then it is preferred for the height of the hopper 20 to be a little higher than that of the height of the sidewalls 22. For example, for a refuse bag 12 having a height of 35 inches for its sidewalls 22, the preferred height of the hopper 20 would be about 36 inches.

The hopper 20 is open at its top **20*a* and also open at its bottom 20*b*. The hopper 20 is constructed of a single piece without any detachable seam, as shown in FIG. 3. The preferred material of construction is plastic, preferably manufactured in the manner that plastic trash receptacles are made. For purposes of ensuring that the hopper 20** confines compaction forces locally to itself only, the plastic composition thereof should be selected from a material having high resistance to expansion under force application at room temperature.

Figure 4:
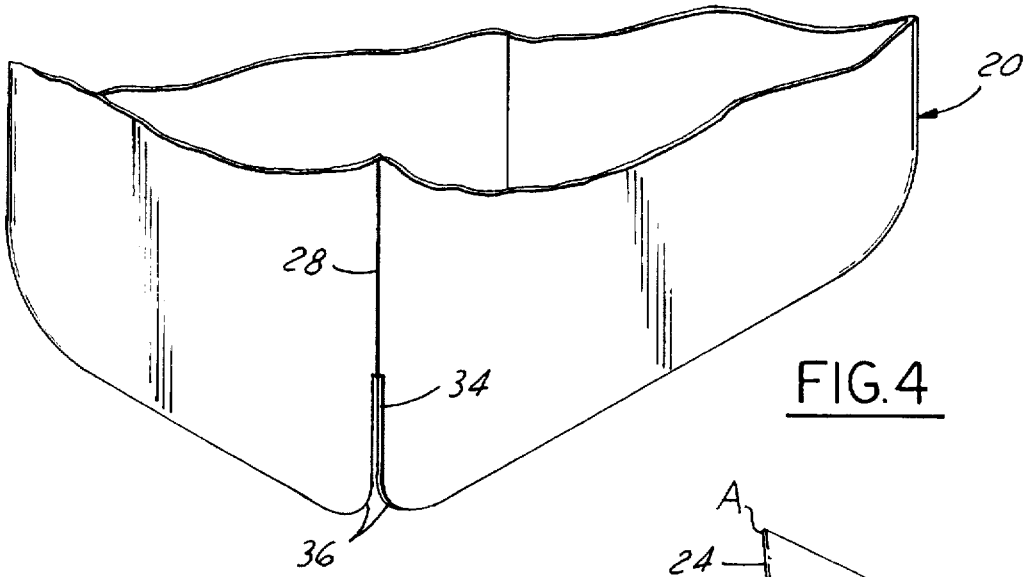
FIG. 4 is a perspective, broken away view of the bottom portion of the hopper insert according to the present invention, showing in particular a corner thereof.

As shown best by FIG. 4, the rounded corners 28 are provided with a slit 34 near the bottom **20*b* of the hopper 20. Further in this regard, it is preferred for the slit 34 to include a bilateral radius 36 at the bottom 20*b* to ensure elimination of sharp edges or points at these corners. The slit 34 allows the hopper to flex near the bottom, thereby aiding in sliding with respect to compacted refuse, as well as relieving a tendency for vacuuming (suctioning) to occur as the hopper is lifted out of the refuse bag after filling has been completed. The slit 34 does not extend too far upwardly from the bottom 20*b*** to pose a problem with regard to sideward forces when refuse is compacted. An example of an acceptable slit length would be about 6 inches for a hopper having a height of 36 inches.

The funnel 24 is preferred to be included with the hopper insert 10, wherein the funnel is integrally connected with the top **20*a* of the hopper 20. The funnel 24 widens with increasing distance from the hopper 20, while preferably keeping the particular cross-sectional shape of the hopper (ie., if the hopper is rectilinearly shaped, the funnel is likewise rectilinearly shaped even as it widens). The funnel 24 opening 38 is wider than that of the cross-sectional area of both the hopper 20 and the mouth 30 of the refuse bag 12, consequently, deposition of refuse 18** into the hopper via the funnel is greatly facilitated by the large opening size thereof.

In order to provide assured ability of a user to manipulate the hopper insert 10, either with or without an associated refuse bag, handholds 40 are provided, such as for example by cut-outs 40*a* in the funnel 24 or by other hand grippable structures.

Operational aspects of the hopper insert 10 will now be detailed, along with a description of the aforementioned compactor tool 16 therefor.

Figure 2:
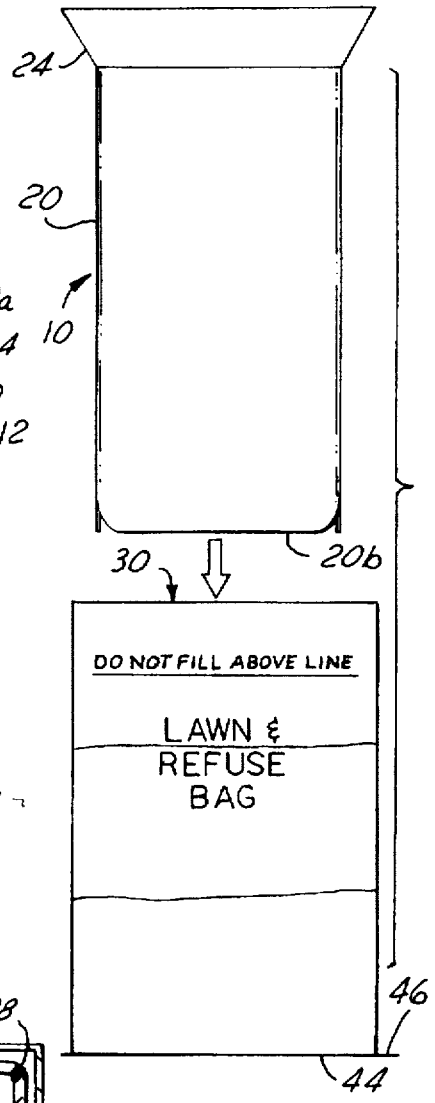
FIG. 2 is a side view of a first preferred method of placing the hopper insert according to the present invention into a refuse bag.
Figure 6:
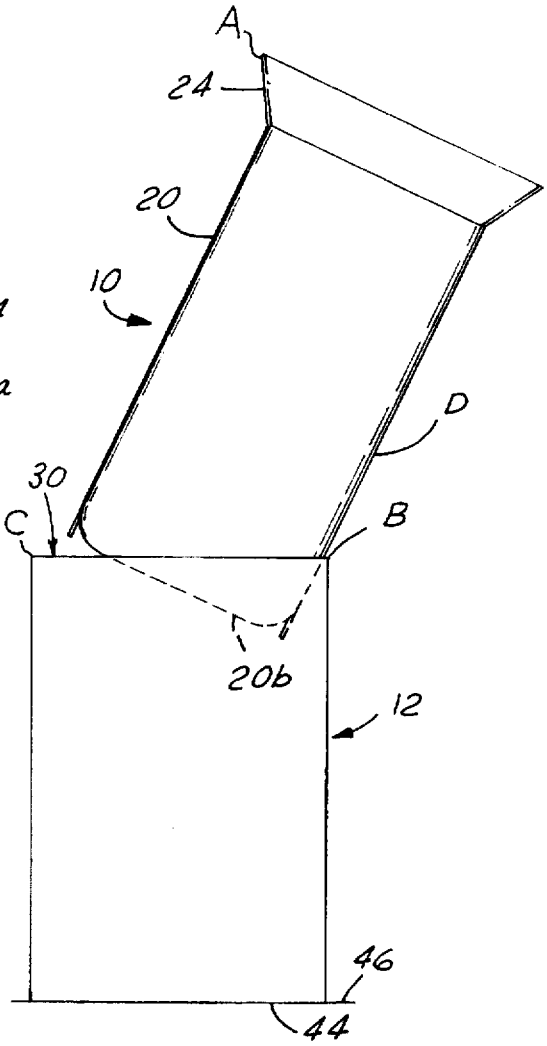
FIG. 6 is a side view of a second preferred method of placing the hopper insert according to the present invention into a refuse bag.

FIGS. 2 and 6 depict two different methods of insertion of the hopper insert 10 into a refuse bag 12. In each case, the refuse bag 12 has been firstly unfolded and configured into is so-called "self-standing", "self-opening" shape, with the bottom wall 44 of the refuse bag 12 resting on the ground 46.

In FIG. 2, the user holds the hopper insert 10 and aligns the bottom 20*b* of the hopper 20 directly over the mouth 30 of the refuse bag 12. Next, the user gently brings the hopper descendingly toward and into the refuse bag until the bottom of the hopper is resting on the bottom wall 44 of the refuse bag.

In FIG. 6, the user holds the hopper insert 10 via a handhold at location A at a convenient to hold acute angle with the ground 46 and then brings the bottom 20*b* of the hopper over the mouth 30 of the refuse bag 12. Next, one side D of the hopper is caused to enter the mouth along one sidewall B of the refuse bag. As the hopper descends into the refuse bag, the user vertically rights the hopper as the bottom thereof clears into the mouth by passing downwardly along the opposite sidewall C. The hopper then continues vertically into the refuse bag until the bottom of the hopper rests on the bottom wall 44 of the refuse bag. During this procedure, the refuse bag 12 may or may not be tilted with respect to the ground in order to facilitate conveniently getting the hopper 20 to insert into the mouth of the refuse bag.

With the hopper 20 now seated inside the sidewalls 22 of the refuse bag 12, the user commences to toss, place, dump, or otherwise cause, refuse 18 to pass into the opening 38 of the funnel 24 and down into the hopper 20, eventually accumulating up from the bottom wall 44 of the refuse bag 12. When the hopper 20 becomes full of refuse 18, if the refuse if loosely arranged, it may be forcibly compressed downwardly from the opening 38 of the funnel 24. The aforementioned compactor tool 16 is useful for this purpose. As shown by FIG. 5, the compactor tool 16 includes a base 48 and a handle 50 medially and normally connected thereto. The base 48 has a smaller cross-sectional area than that of the cross-sectional area of the hopper 20 so it is able to fit thereinside, but preferably is shaped and sized complementary thereto, as shown.

In operation of the compactor tool 16, the user grasps the handle 50, and as shown by FIGS. 1 and 5 aligns the base 48 over the opening 38 of the funnel 24 and then presses downwardly on the handle to cause the base to compress the refuse 18. As shown by FIG. 5, the force of compression F is transmitted via the refuse to the hopper 20 as side forces F'. Because the hopper 20 is formed of a continuously connected undetachable perimeter (ie., having no detachable seams), the side forces F' are locally confined to the hopper and none of the side forces F' are transmitted to the sidewalls 22 of the refuse bag 12.

Now, after the refuse 18 has compactably filled the hopper 20, the user will want to close, seal and dispose of the refuse bag 12. In order to do this, the hopper insert 10 must be removed from the refuse bag 12. The user grabs the funnel 24 via the handholds 40, then pulls upwardly in relation to the refuse bag 12. In this regard, there may be some hesitancy of the hopper 20 to dislodge from the refuse bag 12 on account of the compaction of the refuse 18 as against the hopper. The user need only shake up and down the hopper 20, and the refuse 18 will then remain with the bottom wall 44 of the refuse bag 12. The slit 34 at the rounded corners will aid in the refuse 18 sliding in relation to the hopper 20 as the hopper is slid out of the refuse bag 12, as the hopper is able to flex near its bottom 20*b*; further, suction is minimized because of air passing through the slit. After the hopper insert 10 is removed from the refuse bag 12, the refuse bag is closed, sealed and disposed of in the usual manner, and the hopper insert 10 is again ready for its next refuse bag usage.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A hopper insert for a refuse bag comprising:

a hopper having a predetermined cross-sectional shape, said hopper having an open bottom and an open top, said hopper having an undetachable continuous perimeter;

wherein said hopper has a generally rectilinear cross-section defined by a plurality of corners, said cross-section defining a cross-sectional area, each corner of said plurality of corners being rounded, wherein each corner has a slit near said bottom of said hopper, wherein said slit of each corner terminates in spaced relation with respect to said bottom at said selected location, and wherein said slit is bilaterally radiused adjacent said bottom; and wherein when said hopper is placed into said refuse bag and refuse is placed therein, any side force generated as a result of of a compressional force applied to the refuse in said hopper is kept localized to said hopper.

2. The hopper insert of claim 1, further comprising compactor means for providing the compression of the refuse in said hopper, said compactor means comprising:

a base having a base cross-sectional shape generally complementary to said predetermined cross-sectional shape, wherein said base is receivable into said hopper; and an elongated handle perpendicularly connected with said base.

3. A hopper insert for a refuse bag comprising:

a hopper having a predetermined cross-sectional shape, said hopper having an open bottom and an open top, said hopper having an undetachable continuous perimeter between said top and a selected location with respect to said bottom;

wherein said hopper has a generally rectilinear cross-section defined by a plurality of corners, said cross-section defining a cross-sectional area, each corner of said plurality of corners being rounded, wherein each corner has a slit near said bottom of said hopper, wherein said slit of each corner terminates in spaced relation with respect to said bottom at said selected location, and wherein said slit is bilaterally radiused adjacent said bottom; and wherein when said hopper is placed into said refuse bag and refuse is placed therein, any side force generated as a result of of a compressional force applied to the refuse in said hopper is kept localized to said hopper.

4. The hopper insert of claim 3, further comprising a funnel connected with said top of said hopper.

5. The hopper insert of claim 4, further comprising hand grip means located at said funnel.

6. The hopper insert of claim 5, further comprising compactor means for providing the compression of the refuse in said hopper, said compactor means comprising:

a base having a base cross-sectional shape generally complementary to said predetermined cross-sectional shape, wherein said base is receivable into said hopper; and an elongated handle perpendicularly connected with said base.

7. A refuse bag and hopper insert therefor comprising:

a refuse bag comprising:

a plurality of sidewalls defining a first predetermined cross-sectional shape; and a bottom wall integrally connected with said plurality of sidewalls, wherein a mouth is formed by said plurality of sidewalls opposite said bottom wall, and wherein said mouth is located a first predetermined height in relation to said bottom wall; and a hopper insert comprising:

a hopper having a second predetermined cross-sectional shape, said second predetermined cross-sectional shape being smaller than said first predetermined cross-sectional shape, said hopper having an open bottom and an open top, said hopper having an undetachable continuous perimeter between said top and a selected location with respect to said bottom, said hopper having a second predetermined height, said top having a second predetermined height in relation to said bottom, wherein said second predetermined height is substantially greater than said first predetermined height;

wherein said refuse bag and said hopper each have a respectively corresponding generally rectilinear cross-sectional shape defined, respectively, by a plurality of bag corners and corresponding hopper corners, respectively, wherein each corner of said plurality of hopper corners are rounded, wherein each hopper corner has a slit near said bottom of said hopper, wherein said slit of each corner terminates in spaced relation with respect to said bottom at said selected location, and wherein said slit is bilaterally radiused adjacent said bottom; and wherein when said hopper is placed into said refuse bag and refuse is placed therein, any side force generated as a result of of a compressional force applied to the refuse in said hopper is kept localized to said hopper.

8. The hopper insert of claim 7, further comprising compactor means for providing the compression of the refuse in said hopper, said compactor means comprising:

a base having a base cross-sectional shape generally complementary to said predetermined cross-sectional shape, wherein said base is receivable into said hopper; and an elongated handle perpendicularly connected with said base.

9. The hopper insert of claim 7, further comprising a funnel connected with said top of said hopper.

10. The hopper insert of claim 9, further comprising hand grip means located at said funnel.

11. The hopper insert of claim 6, further comprising compactor means for providing the compression of the refuse in said hopper, said compactor means comprising:

a base having a base cross-sectional shape generally complementary to said predetermined cross-sectional shape, wherein said base is receivable into said hopper; and an elongated handle perpendicularly connected with said base.

* * * * *